US012408754B2

(12) United States Patent
Li et al.

(10) Patent No.: US 12,408,754 B2
(45) Date of Patent: Sep. 9, 2025

(54) ADJUSTABLE BRACKET AND HIGH-FEET SOFA

(71) Applicant: DEWERTOKIN TECHNOLOGY GROUP CO., LTD., Jiaxing (CN)

(72) Inventors: Long Li, Jiaxing (CN); Liming Yang, Jiaxing (CN); Guowei Wang, Jiaxing (CN); Bin Shen, Jiaxing (CN); Kangming Tao, Jiaxing (CN); Qiqi Ye, Jiaxing (CN); Guangjiao Zhang, Jiaxing (CN)

(73) Assignee: DEWERTOKIN TECHNOLOGY GROUP CO., LTD., Jiaxing (CN)

( * ) Notice: Subject to any disclaimer, the term of this patent is extended or adjusted under 35 U.S.C. 154(b) by 257 days.

(21) Appl. No.: 18/272,936

(22) PCT Filed: Aug. 23, 2021

(86) PCT No.: PCT/CN2021/114118
§ 371 (c)(1),
(2) Date: Jul. 18, 2023

(87) PCT Pub. No.: WO2022/156210
PCT Pub. Date: Jul. 28, 2022

(65) Prior Publication Data

US 2024/0156263 A1 May 16, 2024

(30) Foreign Application Priority Data

Jan. 19, 2021 (CN) ..... 202120137056.7

(51) Int. Cl.
*A47C 1/035* (2006.01)
*A47C 1/032* (2006.01)
(Continued)

(52) U.S. Cl.
CPC ..... *A47C 1/0347* (2013.01)

(58) Field of Classification Search
CPC ... A47C 1/0355; A47C 1/0345; A47C 1/0342; A47C 1/02; A47C 3/0255; A47C 7/506; A47C 1/024
See application file for complete search history.

(56) References Cited

U.S. PATENT DOCUMENTS 2,653,193 A 9/1953 Anderson
3,357,739 A 12/1967 Knabusch et al.
(Continued)

FOREIGN PATENT DOCUMENTS

CN 204015666 U 12/2014
CN 106165992 A 11/2016
(Continued)

OTHER PUBLICATIONS

International Search Report for corresponding application PCT/CN2021/114118 filed Aug. 23, 2021; Mail date Nov. 30, 2021.
(Continued)

*Primary Examiner* — Shin H Kim
(74) *Attorney, Agent, or Firm* — CANTOR COLBURN LLP

(57) ABSTRACT

Provided are an adjustable bracket and a high-feet sofa. In the adjustable bracket, the transmission rod is in a straight rod structure. A first end of the transmission rod is connected to the fourth connection rod. A second end of the transmission rod is connected to the pedal rod group. The present disclosure provides an adjustable bracket. In the case of the same sitting height, the adjustable mechanism of a sofa has a more compact structure so that the cleaning work of a mop, a vacuum cleaner, or a floor-sweeping robot is facilitated. Moreover, the height of the sofa from the ground is higher, making the sofa more attractive.

18 Claims, 3 Drawing Sheets

(51) Int. Cl.
*A47C 1/034* (2006.01)
*A47C 1/0355* (2013.01)

(56) References Cited

U.S. PATENT DOCUMENTS

| | | | | |
|---|---|---|---|---|
| 7,997,644 | B2 * | 8/2011 | Hoffman | A47C 3/0255 297/344.21 |
| 8,016,348 | B2 * | 9/2011 | Hoffman | A47C 3/0255 297/85 M |
| 9,314,099 | B2 * | 4/2016 | Huang | A47C 1/0355 |
| 9,433,294 | B2 * | 9/2016 | Donovan | A47C 7/5068 |
| 10,021,980 | B2 * | 7/2018 | Lawson | A47C 1/03211 |
| 10,602,854 | B2 * | 3/2020 | Gu | A47C 7/52 |
| 11,134,781 | B2 * | 10/2021 | Robinson | A47C 1/0355 |
| 11,903,485 | B1 * | 2/2024 | Lawson | A47C 1/0355 |
| 12,201,218 | B2 * | 1/2025 | Lawson | A47C 1/0242 |
| 2013/0175847 | A1 * | 7/2013 | Lawson | A61G 5/14 297/85 M |
| 2015/0054315 | A1 | 2/2015 | Donovan et al. | |

FOREIGN PATENT DOCUMENTS

| | | | |
|---|---|---|---|
| CN | 206303526 | U | 7/2017 |
| CN | 212038159 | U | 12/2020 |
| DE | 10356260 | A1 | 7/2004 |

OTHER PUBLICATIONS

European Search Report for corresponding application EP21920590; Mail date Nov. 12, 2024.

* cited by examiner

ADJUSTABLE BRACKET AND HIGH-FEET SOFA

CROSS-REFERENCE TO RELATED APPLICATION

This is a National stage application, filed under 37 U.S.C. 371, of International Patent Application NO. PCT/CN2021/114118, filed on Aug. 23, 2021, which is based on and claims priority to Chinese Patent Application No. 202120137056.7 filed Jan. 19, 2021, the disclosure of which is incorporated herein by reference in its entirety.

TECHNICAL FIELD

The present disclosure relates to the technical field of furniture design, for example, an adjustable bracket and a high-feet sofa.

BACKGROUND

Sofa has become a very popular piece of furniture in people's daily life, in which an adjustable sofa can achieve adjustment of its inclination angles through the internal sofa bracket structure. With the popularization of intelligent homes, for example, the widespread application of floor-sweeping robots, existing sofas cannot meet the needs of floor-sweeping robots entering the bottom of the sofa for cleaning since the height of sofas from the ground is relatively low. Moreover, the entry of cleaning equipment such as a mop or a vacuum cleaner is also inconvenient.

SUMMARY

The present disclosure provides an adjustable bracket and a high-feet sofa. In the case of the same sitting height, the adjustable mechanism of the high-feet sofa has a more compact structure so that the cleaning work of cleaning equipment is facilitated. Moreover, the height of the high-feet sofa from the ground is higher, making the sofa more attractive.

An embodiment provides an adjustable bracket. The adjustable bracket includes a pedal rod group, a lumbar support rod group, a transmission rod, and a cushion bracket. The lumbar support rod group includes at least a second connection rod, a third connection rod, and a fourth connection rod. The transmission rod is in a straight rod structure. A first end of the transmission rod is connected to the fourth connection rod. A second end of the transmission rod is connected to the pedal rod group.

The present disclosure also provides a high-feet sofa, which includes the preceding adjustable bracket.

REFERENCE LIST

Figure 1:
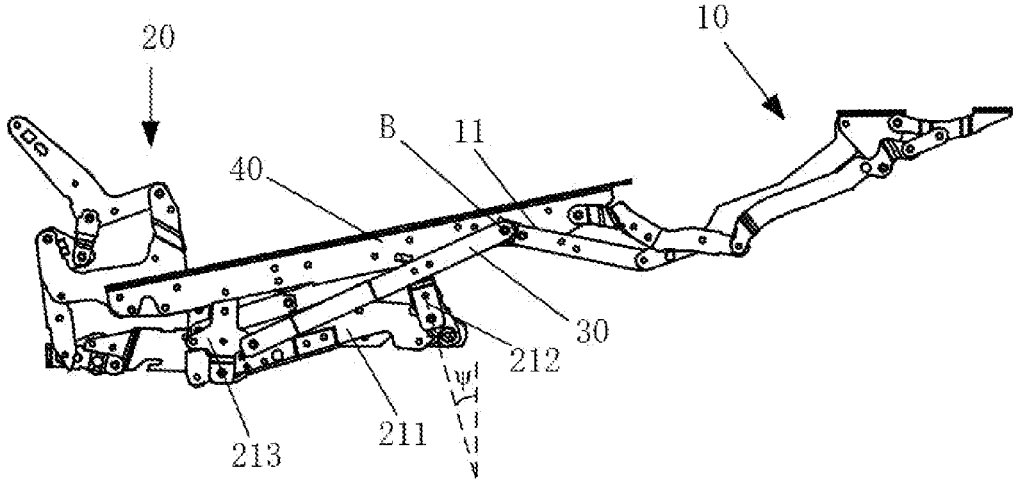
FIG. 1 is a view illustrating the front structure of an adjustable bracket in a fully unfolded state according to an embodiment of the present disclosure.

211' second connection rod
212' third connection rod
213' fourth connection rod
30' transmission rod
40' cushion bracket
10 pedal rod group
11 fifth connection rod
20 lumbar support rod group
211 second connection rod
212 third connection rod
213 fourth connection rod
30 transmission rod
31 first end
32 second end
40 cushion bracket

DETAILED DESCRIPTION

In the description of the present disclosure, unless otherwise expressly specified and limited, a term "connected to each other", "connected" or "secured" is to be construed in a broad sense, for example, as securely connected, detachably connected, or integrated; mechanically connected or electrically connected; directly connected to each other or indirectly connected to each other via an intermediary; or internally connected between two components or interaction relations between two components. For those of ordinary skill in the art, specific meanings of the preceding terms in the present disclosure may be construed according to specific situations.

In the present disclosure, unless otherwise expressly specified and limited, when a first feature is described as "above" or "below" a second feature, the first feature and the second feature may be in direct contact or be in contact via another feature between the two features instead of being in direct contact. Moreover, when the first feature is "on", "above", or "over" the second feature, the first feature is right on, above, or over the second feature, or the first feature is obliquely on, above, or over the second feature, or the first feature is simply at a higher level than the second feature. When the first feature is "under", "below", or "underneath" the second feature, the first feature is right under, below, or underneath the second feature, or the first feature is obliquely under, below, or underneath the second feature, or the first feature is simply at a lower level than the second feature.

In the description of the present disclosure, it should be noted that orientations or position relations indicated by terms such as "above", "below", "right" and the like are based on orientations or position relations shown in the drawings. These orientations or position relations are intended only to facilitate and simplify the operation, and not to indicate or imply that a device or element referred to must have such specific orientations or must be configured or operated in such specific orientations. Thus, these orientations or position relations are not to be construed as limiting the present disclosure. In addition, terms "first" and "second" are used only to distinguish between descriptions and have no special meaning.

The present disclosure provides an adjustable bracket improved on the sofa bracket structure disclosed in reference [1] (Application Publication No. CN111759120A, entitled SOFA BRACKET STRUCTURE and SOFA and published on Oct. 13, 2020). In this embodiment, only the distinguishing features with respect to reference [1] are described in detail. The remaining undisclosed contents can be found in reference [1]. The unmentioned connection position relationship is the same as that of reference [1]. The numbers in the drawings of this embodiment correspond to the reference numerals in reference [1].

Figure 6:
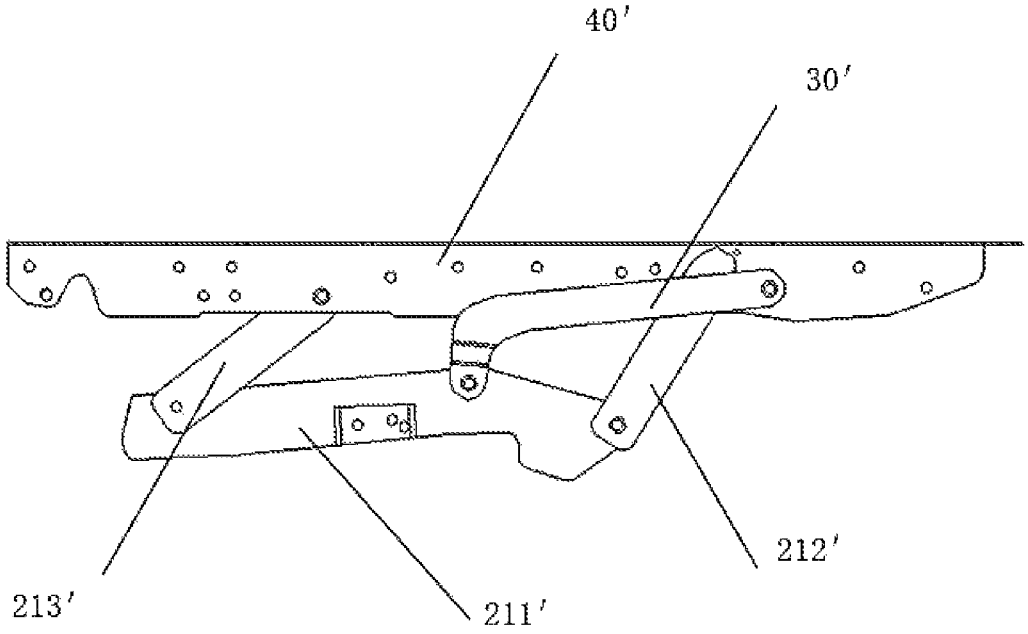
FIG. 6 is a view illustrating the structure of a partial connection-rod mechanism of a sofa bracket structure disclosed in a reference document with Application Publication No. CN111759120A in the related art.

The sofa bracket structure disclosed in reference [1] includes a pedal rod group, a lumbar support rod group, a transmission rod 30', and a cushion bracket 40'. The lumbar support rod group includes at least a second connection rod 211', a third connection rod 212', and a fourth connection rod 213'. As shown in FIG. 6, the transmission rod 30' is provided in a curved shape, a first end of the transmission rod 30' is connected to the second connection rod 211' at the first third of the second connection rod 211', and a second end of the transmission rod 30' is connected to the cushion bracket 40'. Based on this connection, the sofa bracket structure has a stable posture deformation process. The structure, however, is not compact enough, and the height from the ground is still to be improved. To improve the structural compactness at the same sitting height and increase the height of the sofa body from the ground, the present disclosure provides an adjustable bracket and a high-feet sofa.

The adjustable bracket provided by the present disclosure improves the structural shape and connection mode of the transmission rod 30' in the reference [1] so that the adjustable bracket has a more compact structure, and the height of the adjustable bracket from the ground can be increased to obtain a high-feet sofa.

As shown in FIGS. 1 to 5, in this embodiment, an adjustable bracket includes a pedal rod group 10, a lumbar support rod group 20, a transmission rod 30, and a cushion bracket 40. The lumbar support rod group 20 includes at least a second connection rod 211, a third connection rod 212, and a fourth connection rod 213. The transmission rod 30 is in a straight rod structure. A first end of the transmission rod 30 is connected to the fourth connection rod 213. A second end of the transmission rod 30 is connected to the pedal rod group 10.

In this embodiment, the transmission rod 30 is changed from a curved shape to a straight rod shape. Two ends of the transmission rod 30 are connected to the fourth connection rod 213 and the pedal rod group 10 respectively. The length of the transmission rod 30 is extended with respect to that in the related art, and the pedal rod group 10 provides a driving force, which can directly transmit the motion of the pedal rod group 10 to the fourth connection rod 213. Moreover, when switching between a folded state and an unfolded state is performed, it is convenient to change the distance between the transmission rod 30 and the cushion bracket 40 at the same time. The structure is compact so that the height from the ground can be increased.

The present disclosure provides an adjustable bracket. In the case of the same sitting height, the adjustable mechanism of a sofa has a more compact structure so that the cleaning work of a mop, a vacuum cleaner, or a floor-sweeping robot is facilitated. Moreover, the height of the sofa from the ground is higher, making the sofa more attractive.

Optionally, the fourth connection rod 213 is in a cross-shaped configuration and has four first connection ends. Two connection ends opposite to each other up and down are connected to the cushion bracket 40 and the second connection rod 211 respectively. In two remaining connection ends of the four first connection ends, one connection end is connected to a first end 31 of the transmission rod 30, and the other connection end is suspended in the air.

The axially symmetrical cross-shaped structure of the fourth connection rod 213 facilitates position adjustment of the fourth connection rod 213 during installation, thereby improving installation efficiency, avoiding reverse installation, and enhancing assembly quality. One connection end on the top of the fourth connection rod 213 is connected to the cushion bracket 40. Two downward connection ends of the fourth connection rod 213 are sequentially connected to the transmission rod 30 and the second connection rod 211. When the transmission rod 30 moves, the cushion bracket 40 and the second connection rod 211 can be driven to move at the same time. The transmission rod 30 is connected to the middle of the fourth connection rod 213 to drive the cushion bracket 40 and the second connection rod 211 separately. In this manner, the overall adjustment efficiency of the adjustable bracket can be improved, and faster switching between the folded state and the unfolded state can be achieved.

Optionally, the transmission rod 30 and the second connection rod 211 are connected to two side faces of the fourth connection rod 213 respectively.

Figure 2:
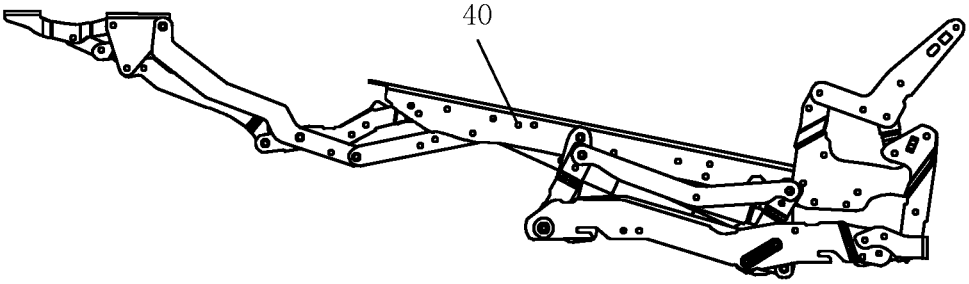
FIG. 2 is a view illustrating the back structure of the adjustable bracket of FIG. 1.
Figure 3:
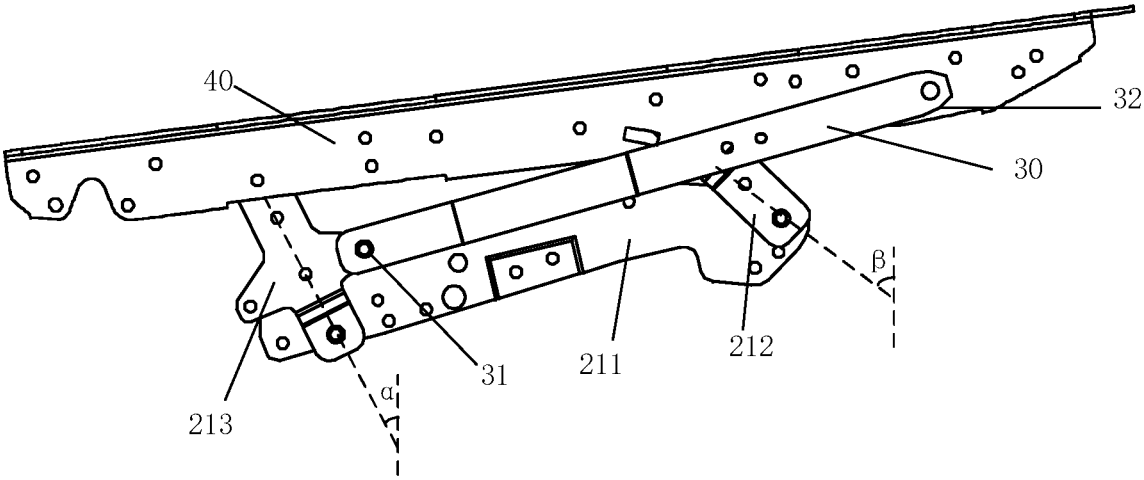
FIG. 3 is a view illustrating the structure of a partial four-connection-rod mechanism in a folded state according to an embodiment of the present disclosure.

As shown in FIG. 3, the fourth connection rod 213 has two side faces that face two sides in the front and rear direction of the adjustable bracket respectively. In FIGS. 1 to 5, towards the right is in a forward position with respect to the second end 32 of the transmission rod 30, and the first end 31 is at the rear. The front-rear direction is hereinafter taken as the standard. In an embodiment shown in FIG. 3, the transmission rod 30 is connected to the side face of the fourth connection rod 213 towards the right, and the second connection rod 211 is connected to the side face of the fourth connection rod 213 towards the left (that is, the side facing away from the paper in FIG. 3). The connection heights of the second connection rod 211 and the transmission rod 30 to the fourth connection rod 213 are different. The distance between the rotation planes is the thickness of the fourth connection rod 213. Therefore, the second connection rod 211, during movement, is not limited by the movement height of the transmission rod 30 and can be further moved toward the cushion bracket 40. In this manner, the structure between the second connection rod 211 and the cushion bracket 40 is more compact, which helps increase the height of the adjustable bracket from the ground.

Figure 4:
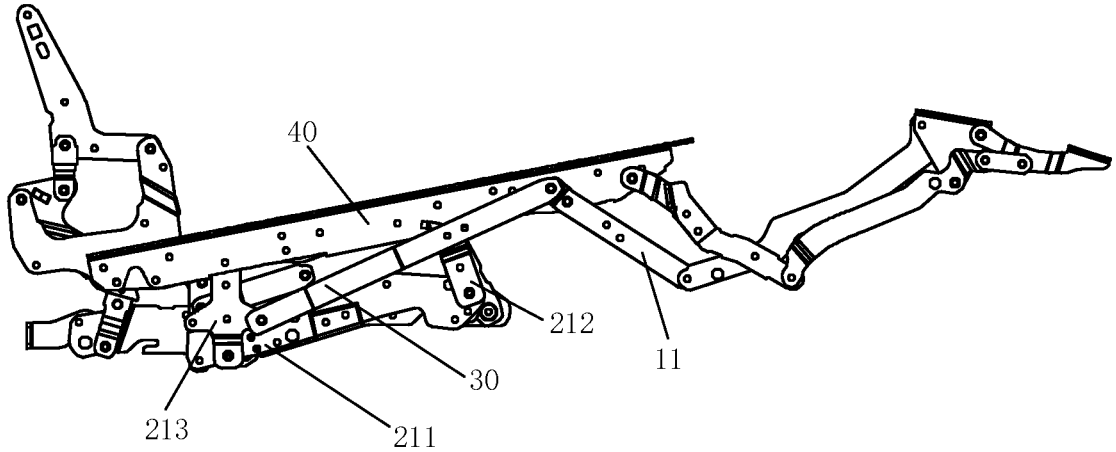
FIG. 4 is a view illustrating the structure of an adjustable bracket in a partially unfolded state or TV posture according to an embodiment of the present disclosure.
Figure 5:
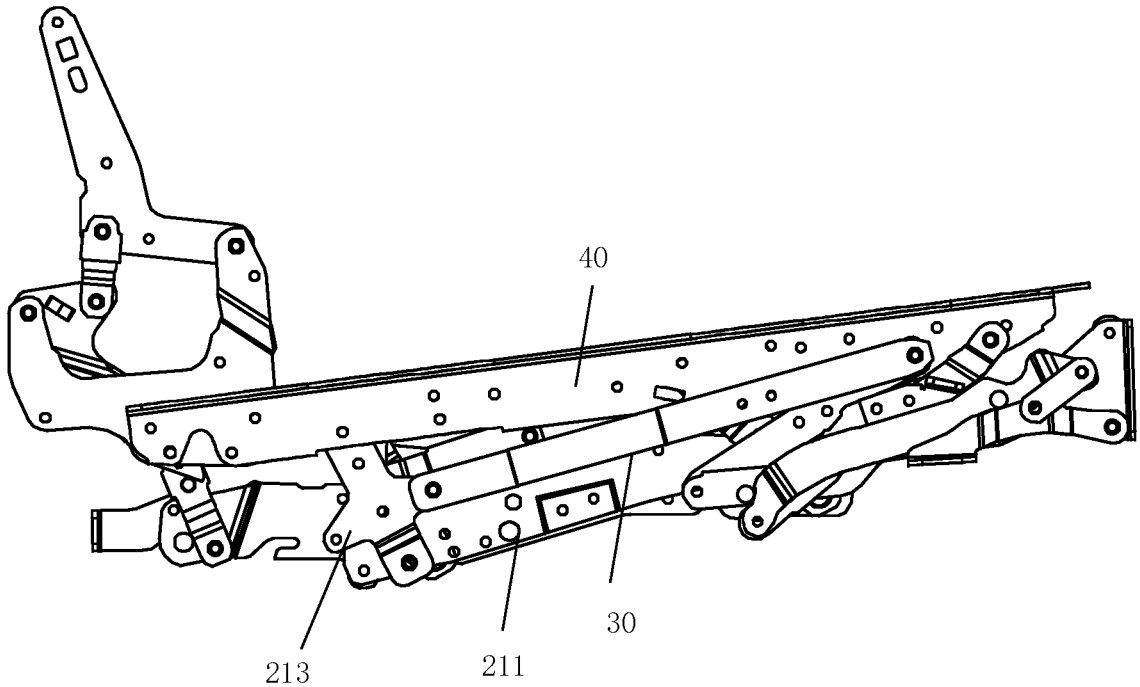
FIG. 5 is a view illustrating the structure of an adjustable bracket in a folded state according to an embodiment of the present disclosure.

The adjustable bracket provided by this embodiment, as a whole, can be adjusted in three postures. FIG. 1 and FIG. 2 are views illustrating the front and back structures of the adjustable bracket in a fully lying posture, that is, a fully unfolded state, respectively. FIG. 4 is a view illustrating the middle posture or TV posture, where the adjustable bracket is in a partially unfolded or half-folded state. FIG. 5 is a view illustrating the structure of the adjustable bracket in a folded state. FIG. 3 is a view illustrating the structure of a partial connection in a folded state shown in FIG. 5. In a folded state, as shown in FIG. 3, the fourth connection rod 213 and the third connection rod 212 have a rearward first inclination angle $\alpha$ and a rearward second inclination angle $\beta$ respectively in a vertical plane. The first inclination angle $\alpha$ is greater than 0° and less than 90°, and the second inclination angle $\beta$ is greater than 0° and less than 90°. In this manner, the structure between the second connection rod 211 and the cushion bracket 40 is more compact, which helps increase the height of the adjustable bracket from the ground.

FIG. 6 shows a sofa bracket structure part disclosed in reference [1] in the related art. The fourth connection rod 213' and the third connection rod 212' have forward inclination angles in the vertical plane. Conversely, in this embodiment as shown in FIG. 3, the fourth connection rod 213 and the third connection rod 212 have rearward inclination angles in the vertical plane. In other words, for each of the fourth connection rod 213 and the third connection rod 212, the bottom is in the forward position with respect to the top. When the sofa bracket structure part is folded, the second connection rod 211 can be retracted more upwards. In this manner, the distance between the second connection rod 211 and the cushion bracket 40 is shortened, and the structure is more compact, which increases the height of the sofa bracket structure part from the ground.

Optionally, two ends of the second connection rod 211 are connected to the third connection rod 212 and the fourth connection rod 213 respectively. One end of the third connection rod 212 that is not connected to the second connection rod 211 and one end of the fourth connection rod 213 that is not connected to the second connection rod 211 are both connected to the cushion bracket 40 to form a closed four-connection-rod mechanism.

As shown in FIG. 3, the closed four-connection-rod mechanism is driven by the transmission rod 30 to rotate deformably. When the second connection rod 211 in the four-connection-rod mechanism is closest to the cushion bracket 40, the adjustable bracket as a whole is in a folded state. When the second connection rod 211 is farthest from the cushion bracket 40, the long-axis direction of the fourth connection rod 213 is generally perpendicular to the long-axis directions of the cushion bracket 40 and the second connection rod 211, and at this time, the adjustable bracket as a whole is in an unfolded state. With respect to the sofa bracket structure shown in FIG. 6, the driving position of the transmission rod 30 is changed from the second connection rod 211 to the fourth connection rod 213 and from the middle position to the end position of the four-connection-rod structure. In this manner, the transmission effect of the transmission rod 30 is better, and the overall folded and unfolded deformation of the four-connection-rod structure is not affected. Moreover, the maximum driving force can be provided, thereby facilitating the overall deformation and transmission stability of the adjustable bracket.

Optionally, in the folded state, a minimum distance between the second connection rod 211 and the cushion bracket 40 is in the range of 110 mm to 140 mm.

As shown in FIG. 6, since the transmission rod 30' is in a curved shape, the rotational position of the first end of the curved portion of the transmission rod 30' during the rotational movement is not only limited by the second connection rod 211', but also restrained by the highest position of the top of the cushion bracket 40'. In this case, the elevation of the second connection rod 211' is limited, and therefore the distance between the second connection rod 211' and the cushion bracket 40' is greatly limited, and the movement cannot be continued. In this embodiment, the shape and connection mode of the transmission rod 30' are changed. The rotational movement of the transmission rod 30 is not limited by the preceding two factors but is only related to the connection position on the fourth connection rod 213. With this configuration, a greater degree of adjustment freedom is achieved so that the second connection rod 211 can be compactly designed toward the cushion bracket 40. In some optional embodiments, the maximum margin L between the second connection rod 211 and the cushion bracket 40 can be up to 110 mm to 140 mm. Compared with that of the sofa adjustment mechanism of the reference [1], the height from ground is greatly improved at the same sitting height.

Optionally, in a fully unfolded state with reference to FIG. 1, the axial direction of the fourth connection rod 213 is a vertical direction, the third connection rod 212 has a rearward third inclination angle ω in the vertical plane, and the third inclination angle ω is smaller than the second inclination angle β.

When the adjustable bracket is changed from a folded state to a fully unfolded state, the transmission rod 30 first drives the rotation of the fourth connection rod 213 so that the first inclination angle and the second inclination angle gradually decrease, and the cushion bracket 40, the third connection rod 212, and the second connection rod 211 all rotate in linkage. The second connection rod 211 moves towards a direction away from the cushion bracket 40, and at the same time the cushion bracket 40 moves upwards and forwards to achieve a state transition. As compared with the cushion bracket 40' in the sofa bracket structure shown in FIG. 6, the cushion bracket 40' moves forward first and then downward when changed from a folded state to an unfolded state in FIG. 6. It can be seen from the comparison that the adjustable bracket provided by this embodiment has a better height from the ground and a compact structure, which helps achieve posture or state conversion.

Optionally, the pedal rod group 10 includes at least a fifth connection rod 11 connected to the second end 32 of the transmission rod 30. The fifth connection rod 11 and the second end 32 are both connected to the cushion bracket 40.

A connection point B of the fifth connection rod 11 and the transmission rod 30 is connected to the cushion bracket 40. The fifth connection rod 11, the transmission rod 30 and the cushion bracket 40 are rotationally connected to each other. When the fifth connection rod 11 provides a rotational driving force to drive the transmission rod 30, the cushion bracket 40 moves upwards and forwards. Compared with the forward and backward movement of the cushion bracket 40 in the related art, the movement of the cushion bracket 40 in this embodiment is more stable. Moreover, the structure is compact, and the height from the ground is increased.

Optionally, the connection point B between the transmission rod 30 and the cushion bracket 40 is in front of a connection point A between the third connection rod 212 and the cushion bracket 40.

As shown in FIGS. 1 and 3, the connection point B is in a more forward position, and the position of the connection point A is disposed backward. In this manner, the formation of a four-connection-rod mechanism with rearward inclination angles is facilitated, which makes the structure of the four-connection-rod mechanism more compact and helps increase the height from the ground to form a high-feet sofa, a high-feet seat, or the like.

Based on the adjustable bracket provided by the preceding embodiments, the present disclosure also provides a high-feet sofa. By provision of the adjustable bracket under the sofa cushion, the height of the bottom of the sofa is higher from the ground at the same sitting height, the sofa is more attractive, and the adjustable mechanism of the sofa has a compact structure, thereby facilitating cleaning of the bottom of the sofa.

What is claimed is:

1. An adjustable bracket, comprising: a pedal rod group, a lumbar support rod group, a transmission rod, and a cushion bracket, wherein the lumbar support rod group comprises at least a second connection rod, a third connection rod, and a fourth connection rod; and the transmission rod is in a straight rod structure, a first end of the transmission rod is connected to the fourth connection rod, and a second end of the transmission rod is connected to the pedal rod group.

2. The adjustable bracket according to claim 1, wherein the fourth connection rod is in a cross-shaped configuration and has a first connection end, a second connection end, a third connection end, and a fourth connection end, wherein the first connection end and the second connection end opposite to each other up and down are connected to the cushion bracket and the second connection rod respectively, the third connection end is connected to the first end of the transmission rod, and the fourth connection end is suspended in the air.

3. The adjustable bracket according to claim 1, wherein the transmission rod and the second connection rod are connected to two side faces of the fourth connection rod respectively.

4. The adjustable bracket according to claim 1, wherein two ends of the second connection rod are connected to the third connection rod and the fourth connection rod respectively, and one end of the third connection rod that is not connected to the second connection rod and one end of the fourth connection rod that is not connected to the second connection rod are both connected to the cushion bracket to form a closed four-connection-rod mechanism.

5. The adjustable bracket according to claim 4, wherein in a folded state, the fourth connection rod and the third connection rod have a rearward first inclination angle and a rearward second inclination angle respectively in a vertical plane, wherein the first inclination angle is greater than 0° and less than 90°, and the second inclination angle is greater than 0° and less than 90°.

6. The adjustable bracket according to claim 5, wherein in the folded state, a minimum distance between the second connection rod and the cushion bracket is in a range of 110 mm to 140 mm.

7. The adjustable bracket according to claim 5, wherein in a fully unfolded state, an axial direction of the fourth connection rod is a vertical direction, the third connection rod has a rearward third inclination angle in the vertical plane, and the third inclination angle is smaller than the second inclination angle.

8. The adjustable bracket according to claim 1, wherein the pedal rod group comprises at least a fifth connection rod connected to the second end of the transmission rod, and the fifth connection rod and the second end are connected to the cushion bracket at a connection point between the fifth connection rod and the second end.

9. The adjustable bracket according to claim 1, wherein a first connection point between the transmission rod and the cushion bracket is in a forward position with respect to a second connection point between the third connection rod and the cushion bracket.

10. A high-feet sofa, comprising an adjustable bracket, wherein the adjustable bracket comprises: a pedal rod group, a lumbar support rod group, a transmission rod, and a cushion bracket, wherein the lumbar support rod group comprises at least a second connection rod, a third connection rod, and a fourth connection rod; and the transmission rod is in a straight rod structure, a first end of the transmission rod is connected to the fourth connection rod, and a second end of the transmission rod is connected to the pedal rod group.

11. The high-feet sofa according to claim 10, wherein the fourth connection rod is in a cross-shaped configuration and has a first connection end, a second connection end, a third connection end, and a fourth connection end, wherein the first connection end and the second connection end opposite to each other up and down are connected to the cushion bracket and the second connection rod respectively, the third connection end is connected to the first end of the transmission rod, and the fourth connection end is suspended in the air.

12. The high-feet sofa according to claim 10, wherein the transmission rod and the second connection rod are connected to two side faces of the fourth connection rod respectively.

13. The high-feet sofa according to claim 10, wherein two ends of the second connection rod are connected to the third connection rod and the fourth connection rod respectively, and one end of the third connection rod that is not connected to the second connection rod and one end of the fourth connection rod that is not connected to the second connection rod are both connected to the cushion bracket to form a closed four-connection-rod mechanism.

14. The high-feet sofa according to claim 13, wherein in a folded state, the fourth connection rod and the third connection rod have a rearward first inclination angle and a rearward second inclination angle respectively in a vertical plane, wherein the first inclination angle is greater than 0° and less than 90°, and the second inclination angle is greater than 0° and less than 90°.

15. The high-feet sofa according to claim 14, wherein in the folded state, a minimum distance between the second connection rod and the cushion bracket is in a range of 110 mm to 140 mm.

16. The high-feet sofa according to claim 14, wherein in a fully unfolded state, an axial direction of the fourth connection rod is a vertical direction, the third connection rod has a rearward third inclination angle in the vertical plane, and the third inclination angle is smaller than the second inclination angle.

17. The high-feet sofa according to claim 10, wherein the pedal rod group comprises at least a fifth connection rod connected to the second end of the transmission rod, and the fifth connection rod and the second end are connected to the cushion bracket at a connection point between the fifth connection rod and the second end.

18. The high-feet sofa according to claim 10, wherein a first connection point between the transmission rod and the cushion bracket is in a forward position with respect to a second connection point between the third connection rod and the cushion bracket.

* * * * *